US007620349B2

(12) United States Patent
Katsuyama

(10) Patent No.: US 7,620,349 B2
(45) Date of Patent: Nov. 17, 2009

(54) AGENT CONTAINING UNIT HAVING IMPROVED USABILITY, AGENT REFILL UNIT, AND IMAGE FORMING APPARATUS

(75) Inventor: Goro Katsuyama, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 443 days.

(21) Appl. No.: 11/374,996

(22) Filed: Mar. 15, 2006

(65) Prior Publication Data

US 2006/0210319 A1 Sep. 21, 2006

(30) Foreign Application Priority Data

Mar. 15, 2005 (JP) ..... 2005-073182
Mar. 15, 2005 (JP) ..... 2005-073183
Mar. 15, 2005 (JP) ..... 2005-073185

(51) Int. Cl.
*G03G 15/08* (2006.01)

(52) U.S. Cl. ..... 399/260; 399/261; 399/106; 399/258

(58) Field of Classification Search ..... 399/102, 399/103, 106, 258, 260, 13, 261
See application file for complete search history.

(56) References Cited

U.S. PATENT DOCUMENTS 4,650,070 A * 3/1987 Oka et al. ..... 399/119
5,150,807 A * 9/1992 Seyfried et al. ..... 399/106
6,526,246 B2 * 2/2003 Iwata et al. ..... 399/258
6,549,744 B2 4/2003 Terazawa et al.
6,628,913 B2 9/2003 Matsumoto et al.
6,771,921 B2 * 8/2004 Katsuyama ..... 399/258

FOREIGN PATENT DOCUMENTS

JP 62121470 A * 6/1987
JP 04084182 A * 3/1992
JP 2002-046843 2/2002
JP 2002-357947 12/2002
JP 2004-117417 4/2004
JP 2004-333705 11/2004

OTHER PUBLICATIONS

U.S. Appl. No. 11/567,548, filed Dec. 6, 2006, Taguchi, et al.
U.S. Appl. No. 11/567,601, filed Dec. 6, 2006, Taguchi, et al.

(Continued)

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

An agent containing unit for use in an image forming apparatus includes a container, a discharge port unit, and a support plate. The container stores an agent and has an opening on one end portion of the container. The discharge port unit is attached to the opening of the container, and covers the opening of the container and has a first discharge port, through which the agent is discharged from the container. The support plate supports the container, fixed detachably on the support plate, and has a second discharge port, which is aligned with the first discharge port.

27 Claims, 9 Drawing Sheets

OTHER PUBLICATIONS

U.S. Appl. No. 11/566,882, filed Dec. 5, 2006, Taguchi, et al.
U.S. Appl. No. 11/566,897, filed Dec. 5, 2006, Taguchi, et al.
U.S. Appl. No. 11/567,589, filed Dec. 6, 2006, Taguchi, et al.
U.S. Appl. No. 11/566,828, filed Dec. 5, 2006, Taguchi, et al.
U.S. Appl. No. 11/566,852, filed Dec. 5, 2006, Taguchi, et al.
U.S. Appl. No. 11/567,568, filed Dec. 6, 2006, Taguchi, et al.

* cited by examiner

AGENT CONTAINING UNIT HAVING IMPROVED USABILITY, AGENT REFILL UNIT, AND IMAGE FORMING APPARATUS

TECHNICAL FIELD

The present disclosure generally relates to an agent containing unit, an agent refill unit, and an image forming apparatus having an agent containing unit and an agent refill unit.

BACKGROUND

An image forming apparatus such as printer, copier, facsimile has a developing unit to develop a toner image with a developing agent having toners and carriers.

Toners are consumed as image forming progresses, thereby the image forming apparatus includes a toner container (e.g., toner bottle and toner cartridge) to store toners in the image forming apparatus, and a toner refill unit supplies toners to the developing unit from the toner container.

When the toner container becomes empty, the toner container is replaced from the image forming apparatus, and a new toner container is installed in the image forming apparatus. Such toner containers are made of hard material (hereinafter, hard casing), in general.

However, such hard casing has drawbacks in terms of recovery cost because of the relatively large volume of the hard casing. Thereby some toner containers have been changed to a softer casing, which has a relatively smaller volume.

However, such softer casing having flexibility is not preferable from the viewpoint of keeping the toner container in a predetermined position when the toner container is installed in the image forming apparatus. Thereby, instead of installing a softer casing directly in the image forming apparatus, a hard box encasing a softer casing may be installed in the image forming apparatus.

Furthermore, some toners still remain in the toner container even if a toner end (i.e., toner empty) condition is detected in the image forming apparatus. Generally, it is difficult to completely discharge toners from the toner container.

In order to reduce the amount of toners remaining in the toner container after the toner end (i.e., toner empty) condition, the toner discharge port of the toner container can be preferably made larger.

However, a larger toner discharge port may be more likely to cause drawbacks such as toner scattering and toner leakage.

When an empty toner container is removed from the image forming apparatus, the toner discharge port is required to be closed to prevent toner related contamination such as toner scattering and toner leakage. If the toner discharge port is not closed completely, such toner related contamination may occur.

Therefore, the smaller the opening area of the toner discharge port of the toner container, the easier it is to prevent the occurrence of the toner related contamination.

A new toner container is required to be in a toner refillable condition by opening the toner discharge port when the new toner container is installed in a predetermined position in the image forming apparatus.

Therefore, the smaller the opening area of the toner discharge port of the toner container, the easier it is to open the toner discharge port when the toner container is installed in a predetermined position.

However, if the opening area of the toner discharge port of the toner container is too small, a larger amount of toners may be more likely to remain in the toner container at toner end (i.e., toner empty) condition.

In general, the toner container is replaced by a user, thereby the user feel some degree of unhappiness if a larger amount of toners still remain in the toner container when the user removed the toner container from the image forming apparatus. In such case, the user may install the retrieved toner container again in the image forming apparatus because the user may judge that the toner container is not empty.

A related art container employs an oscillating mechanism as a toner refill unit to refill toners stably and to reduce the amount of toners remaining in the toner container at toner end (i.e., toner empty) condition.

Such oscillating mechanism oscillates a toner container and suddenly stops the toner container so that toners in the toner container can move to a toner discharging port with inertia force. With such configuration, toners can be discharged from the toner discharging port more easily, thereby toners remained in the toner container may be reduced at a toner end (i.e., toner empty) condition.

In such oscillating mechanism, the toner container is required to be firmly fixed to the oscillating mechanism because the toner container is oscillated by the oscillating mechanism.

However, if the toner container employs a softer casing, such softer casing may have difficulty in being firmly fixed to the oscillating mechanism, although the softer casing is preferable from a viewpoint of cost such as distribution costs and recovering cost.

On one hand, however, if the toner container is fixed to the oscillating mechanism too firmly, the attachment/detachment work of the toner container in an image forming apparatus may become difficult.

Furthermore, even if the toner container is fixed to the oscillating mechanism firmly, toners may not be discharged effectively from the toner discharge port if toner fluidity deteriorates (e.g., clogging occurs).

In order to cope with such drawbacks on toner discharge effectiveness, the opening area of the toner discharge port is preferably set to be larger for effective toner discharge.

However, the larger the opening area of the toner discharge port of the toner container, the harder it is to prevent the occurrence of toner related contamination such as toner scattering and toner leakage when the toner container is attached/detached in the image forming apparatus.

From the viewpoint of stable toner discharge from the toner container, a larger toner discharge port is preferable, however, from the viewpoint of preventing toner related contamination, a smaller toner discharge port is preferable.

Furthermore, toner related contamination such as toner scattering and toners leakage may occur for a conventional toner container if a user opens a toner discharge port of the toner container unintentionally before the toner container is installed in an image forming apparatus.

In order to prevent such unintentional opening of the toner discharge port of a toner container, the toner discharge port of the toner container can be sealed with a seal member.

However, a user may forget to peel off the seal member from the toner container, and install such toner container in an image forming apparatus without peeling off the seal member.

SUMMARY

The present disclosure relates to an agent containing unit for use in an image forming apparatus. The agent containing unit includes a container, a discharge port unit, and a support plate. The container stores an agent and has an opening on one end portion of the container. The discharge port unit is attached to the opening of the container, and covers the opening of the container and has a first discharge port, through which the agent is discharged from the container. The support plate supports the container, fixed detachably on the support plate, and has a second discharge port, which is aligned with the first discharge port.

The present disclosure also relates to an agent refill unit for use in an image forming apparatus. The agent refill unit includes an agent containing unit, an oscillating unit, and a shutter opening/closing mechanism. The agent containing unit includes a container, a discharge port unit, and a support plate. The container stores an agent and has an opening on one end portion of the container. The discharge port unit is attached to the opening of the container, and covers the opening of the container and has a first discharge port, through which the agent is discharged from the container. The support plate supports the container, fixed detachably on the support plate, and has a second discharge port, which is aligned to the first discharge port. The oscillating unit accepts and supports the agent containing unit and has a third discharge port, which is aligned to the first and second discharge port. The shutter opening/closing mechanism opens and closes the first shutter.

The present disclosure also relates to an image forming apparatus having an agent refill unit. The agent refill unit includes an agent containing unit, an oscillating unit, and a shutter opening/closing mechanism. The agent containing unit includes a container, a discharge port unit, and a support plate. The container stores an agent and has an opening on one end portion of the container. The discharge port unit is attached to the opening of the container, and covers the opening of the container and has a first discharge port, through which the agent is discharged from the container. The support plate supports the container, fixed detachably on the support plate, and has a second discharge port, which is aligned to the first discharge port. The oscillating unit accepts and supports the agent containing unit and has a third discharge port, which is aligned with the first and second discharge port. The shutter opening/closing mechanism opens and closes the first shutter.

BRIEF DESCRIPTION OF THE DRAWINGS

A more complete appreciation of the invention and many of the attendant advantages thereof will be readily obtained and understood from the following detailed description with reference to the accompanying drawings, wherein.

DETAILED DESCRIPTION OF THE PREFERRED EMBODIMENTS

Figure 1:
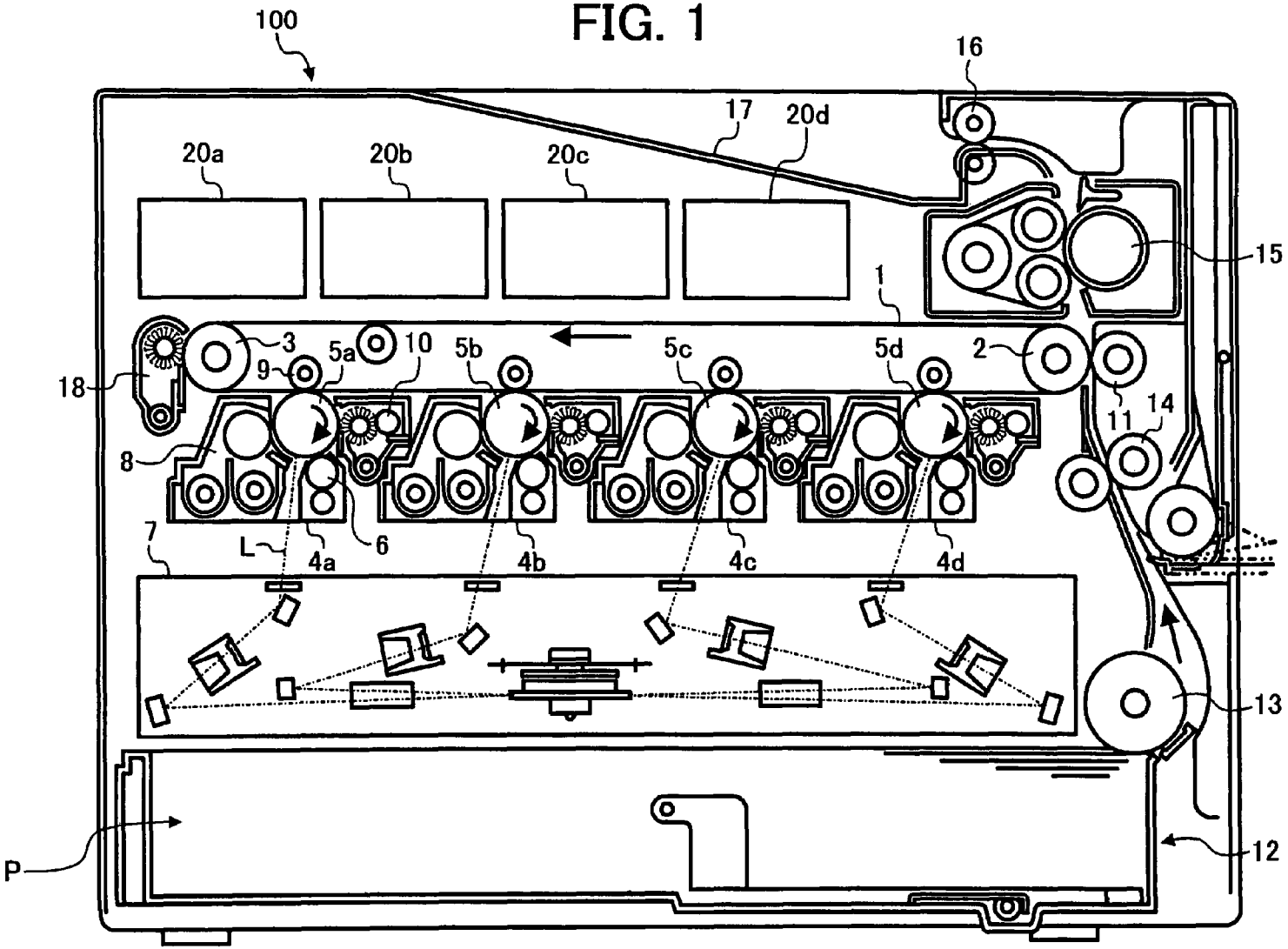
FIG. 1 is a schematic view of an image forming apparatus according to an example embodiment.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with reference to FIG. 1.

FIG. 1 is a schematic view of an image forming apparatus 100 according to an example embodiment, wherein the image forming apparatus 100 includes a color printer, for example.

As shown in FIG. 1, the image forming apparatus 100 includes an intermediate transfer belt 1, image forming units 4*a*, 4*b*, 4*c*, and 4*d*, an optical writing unit 7, a developing unit 8, a sheet feed unit 12, a fixing unit 15, and toner cartridges 20*a*, 20*b*, 20*c*, and 20*d*.

The intermediate transfer belt 1 serving as image carrying member is disposed in an upper section of the image forming apparatus 100.

The intermediate transfer belt 1 is extended by rollers 2 and 3, wherein any one of the rollers 2 and 3 can be used as a drive roller for driving the intermediate transfer belt 1. When the drive roller rotates in a counter-clockwise direction, the intermediate transfer belt 1 travels in the direction shown by an arrow in FIG. 1.

As shown in FIG. 1, the image forming units 4*a*, 4*b*, 4*c*, and 4*d* are disposed under the intermediate transfer belt 1 and faces the intermediate transfer belt 1.

Each of the image forming units 4*a*, 4*b*, 4*c*, and 4*d* includes respective photosensitive members 5*a*, 5*b*, 5*c*, and 5*d* in drum shape as image carrying member, and a charge roller 6.

Each of the photosensitive members 5*a*, 5*b*, 5*c*, and 5*d* respectively forms magenta toner image, cyan toner image, yellow toner image and black toner image on a surface of the respective photosensitive members 5*a*, 5*b*, 5*c*, and 5*d*.

The image forming units 4*a*, 4*b*, 4*c*, and 4*d* have similar configurations with one another, thereby the image forming unit 4*a* having the photosensitive member 5*a* is explained as a representative of the image forming units 4*a*, 4*b*, 4*c*, and 4*d*, hereinafter.

The photosensitive member 5*a* rotates in a clockwise direction in FIG. 1, and the charge roller 6 uniformly charges a surface of the photosensitive member 5*a* with a predetermined voltage having a polarity.

Then, the charged surface of the photosensitive member 5*a* is irradiated with a laser beam L emitted from the optical writing unit 7 to form an electrostatic latent image on the photosensitive member 5*a*, wherein the laser beam L is modulated based on image data.

The developing unit 8 develops the electrostatic latent image on the photosensitive member 5*a* as magenta toner image, for example.

As shown in FIG. 1, a primary transfer roller 9 faces the photosensitive member 5*a*via the intermediate transfer belt 1, and the primary transfer roller 9 is applied with a voltage having an opposite polarity with respect to the magenta toner image.

With the effect of the transfer roller 9, the magenta toner image is transferred to the photosensitive member 5*a* from the intermediate transfer belt 1 at a primary transfer nip defined by the transfer roller 9, the photosensitive member 5*a*, and the intermediate transfer belt 1.

After transferring the magenta toner image to the intermediate transfer belt 1, toners remaining on the photosensitive members 5*a* are removed by a cleaning unit 10.

Similarly, cyan toner image, yellow toner image and black toner image are formed on the respective photosensitive members 5*b*, 5*c*, and 5*d* in the image forming units 4*b*, 4*c*, and 4*d*, and then such toner images are super-imposingly transferred onto the intermediate transfer belt 1 having the magenta toner image.

Such toner images formed on the intermediate transfer belt 1 are moved to a secondary transfer nip, defined by the roller 2 and a secondary transfer roller 11, with a traveling of the intermediate transfer belt 1.

The image forming apparatus 100 includes the sheet feed unit 12 in a lower side of the image forming apparatus 100 as shown in FIG. 1.

A sheet feeder 13 feeds a recording medium P such as transfer sheet from the sheet feed unit 12 to a registration roller 14 in a direction shown by an arrow in FIG. 1.

The registration roller 14 holds the recording medium P temporally, and feeds the recording medium P to the secondary transfer nip for the intermediate transfer belt 1 with a predetermined timing so that the toner images can be transferred on the recording medium P.

The secondary transfer roller 11 is applied with a voltage having an opposite polarity with respect to the toner images. With the effect of the secondary transfer roller 11, the toner images are transferred from the intermediate transfer belt 1 to the recording medium P at the secondary transfer nip.

Then, the recording medium P is fed to the fixing unit 15 to fix the toner images on the recording medium P.

After such fixing process, the recording medium P is ejected to an ejection tray 17 by an ejection roller 16.

After transferring the toner images from the intermediate transfer belt 1 to the recording medium P, toners remaining on the intermediate transfer belt 1 are removed by a belt cleaning unit 18, wherein the belt cleaning unit 18 faces the roller 3 via the intermediate transfer belt 1 as shown in FIG. 1.

The toner cartridges 20*a*, 20*b*, 20*c*, and 20*d*, serving as toner containing unit are installed in a compartment allocated over the intermediate transfer belt 1 and under the ejection tray 17, wherein the toners are refilled into the developing units 8*a*, 8*b*, 8*c*, and 8*d*from the respective toner cartridges 20*a*, 20*b*, 20*c*, and 20*d*.

The toner cartridges 20*a*, 20*b*, 20*c*, and 20*d* can be used as agent containing unit, which contain any one of toner, carrier, and a developing agent having toner and carrier.

Figure 2:
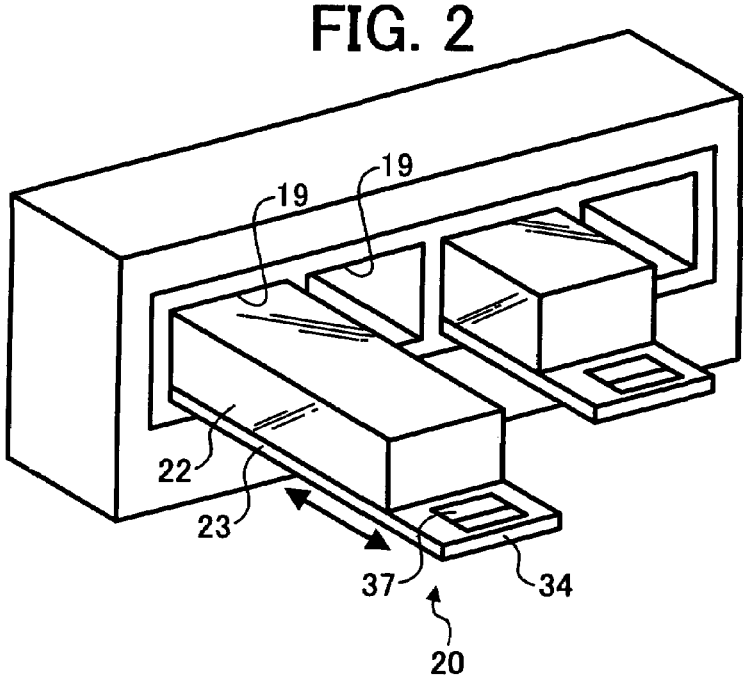
FIG. 2 is a schematic perspective view of a compartment for installing a toner cartridge in an image forming in FIG. 1.

As shown in FIG. 2, the compartment includes an insertion port 19, from which the toner cartridge 20 is inserted into the compartment. The toner cartridge 20 has the shape of a rectangular parallelepiped form, for example.

In an example embodiment, a toner-refill unit employs an oscillating mechanism to supply toners to the developing units 8*a*, 8*b*, 8*c*, and 8*d* from the respective toner cartridges 20*a*, 20*b*, 20*c*, and 20*d*.

Hereinafter, the oscillating mechanism is explained with reference to FIG. 3.

Figure 3:
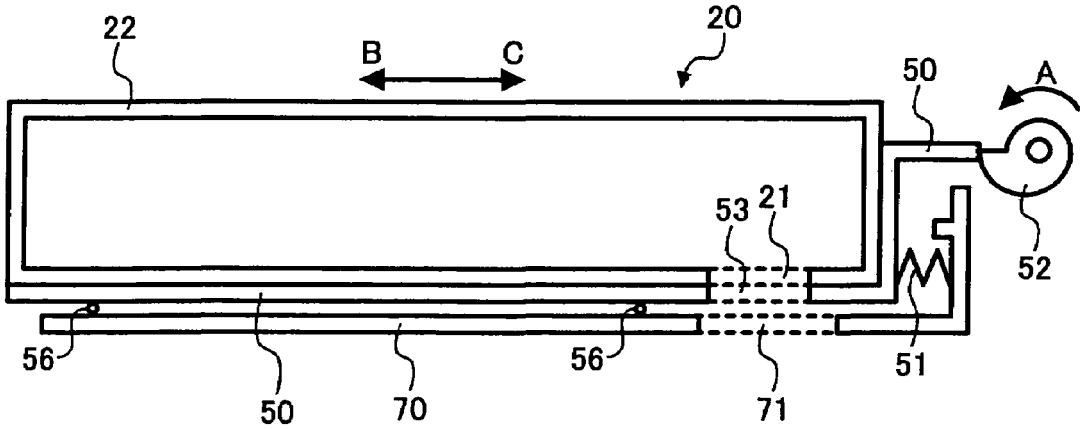
FIGS. 3 and 4 are schematic views illustrating a method of discharging toners from a toner cartridge according to an example embodiment.

As shown in FIG. 3, the oscillating mechanism includes an oscillating unit 50 having an open port 53, a roller 66, a support base 70 having an open port 71, a spring 51, and a cam 52.

The oscillating unit 50 can be moved bi-directionally as shown by arrows of B and C on the support base 70 by using the spring 5 1, cam 52, and roller 66.

The toner cartridge 20 having a toner discharge port 21 is fixed on the oscillating unit 50 while aligning the toner discharge port 21 to the open port 53 of the oscillating unit 50 as shown in FIG. 3.

The spring 51 is fixed to the oscillating unit 50 and the support base 70 as shown in FIG. 3 so that the oscillating unit 50 can be constantly biased in a direction shown by an arrow C.

Figure 4:
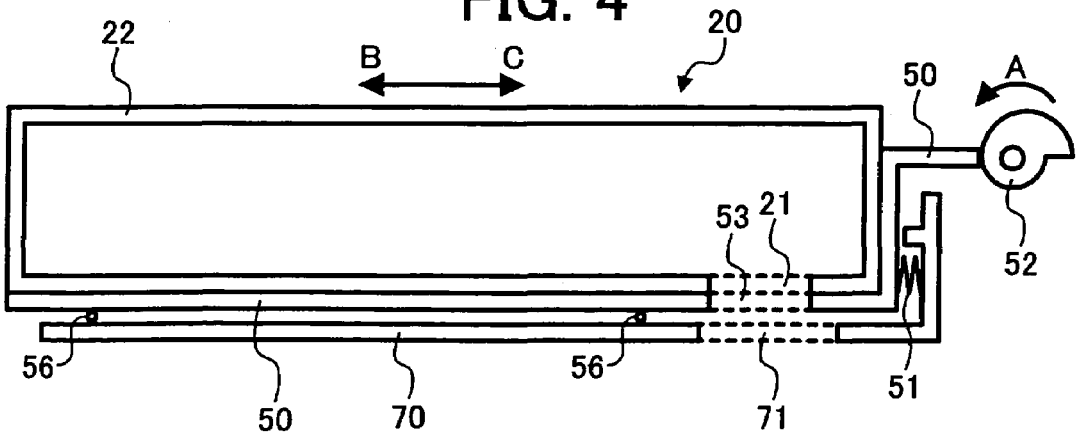

The cam 52 contacts the oscillating unit 50 as shown in FIGS. 3 and 4.

As shown in FIG. 3, when the cam 52 rotates in a direction shown by an arrow A, the oscillating unit 50 moves in a direction shown by an arrow B, thereby the spring 51 is extended.

When the cam 52 reaches and passes a peak, the oscillating unit 50 accelerately moves in a direction shown by an arrow C with an effect of the spring 51 as shown in FIG. 4.

The oscillating unit 50, having fixed the toner cartridge 20 thereon, collides the support base 70 with some speed and stops.

Therefore a moving speed of the toner cartridge 20 changes significantly with such collision of the oscillating unit 50 to the support base 70.

With such significant change of moving speed of the toner cartridge 20, a greater acceleration is generated in the direction shown by an arrow C, by which toners in the toner cartridge 20 moves in a direction shown by an arrow C with an effect of inertia force.

Accordingly, toners in the toner cartridge 20 can be discharged from the discharge port 21 effectively.

The discharged toners are then refilled to the developing unit 8 by a transporting unit (not shown).

As for the oscillating mechanism configured to discharge toners from the toner cartridge 20 with such movement, it is required to fix the toner cartridge 20 firmly on the oscillating unit 50, and also required to open the toner discharge port 21 and to align the toner discharge port 21 to the open port 53 of the oscillating unit 50 when the toner cartridge 20 is set on the oscillating unit 50 so that toners can be discharged from the toner cartridge 20.

Hereinafter, the toner cartridge 20 is explained as below.

Figure 5:
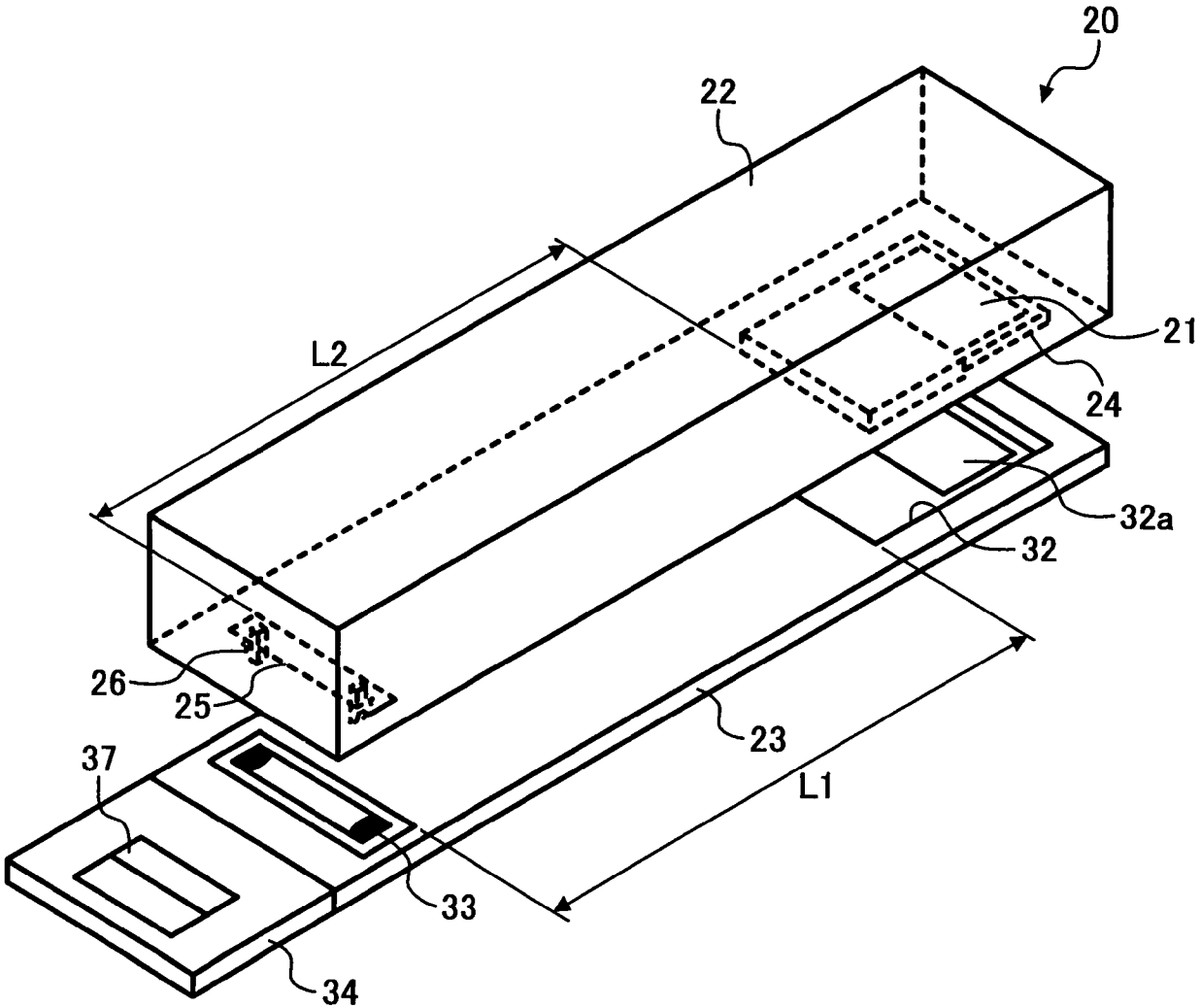
FIG. 5 is a schematic perspective view of a toner cartridge according to an example embodiment.

As shown in FIG. 5, the toner cartridge 20 includes a container 22, and a support plate 23, wherein the container 22 is detachably fixed to the support plate 23.

The container 22 can be made of a soft material, which includes thermoplastic material such as polyvinyl chloride, and is shaped in a substantially rectangular parallelepiped form as shown in FIG. 5, for example.

From the view of cost such as manufacturing costs, distribution costs, and recovering costs, the container 22 is preferably made of such thermoplastic material, which is a softer material.

Furthermore, the container 22 can include a transparent container so that a user can recognizes color type of toners easily.

Furthermore, the container 22 can include a paper-composite container. The paper-composite container can be made of paper and resinous material such as thermoplastic material, in which a resinous layer is laminated on a paper layer. By laminating the resinous layer on the paper layer, the paper-composite container can have a preferable strength and anti-moisture property, which may not be obtained by a paper container. Furthermore, such paper-composite container can be fused with a discharge port unit 24 to be described later by providing the resinous layer for the paper-composite container.

For example, such paper-composite container has an outer surface mainly formed of paper layer and an inner surface formed of resinous layer, which is laminated on the paper layer.

Although not shown, the container 22 can be connected to an air-sucking unit such as pump when the toner cartridge 20 is installed in the image forming apparatus. With such configuration, the air-sucking unit can suck the air in the container 22 when the container 22 becomes empty to reduce the volume of the empty container 22, which is preferable from a viewpoint of handling work for the toner cartridge 20 such as replacement, recovering, and discarding.

The support plate 23 can be made a rigid material, which includes a thermosetting material having rigidity when the thermosetting material is formed into the support plate 23.

Therefore, the support plate 23 has hardness, which is harder than the container 22.

As shown in FIGS. 5 and 6, the container 22 includes a discharge port unit 24 on one end portion of the bottom face of the container 22, wherein the discharge port unit 24 faces the support plate 23.

The discharge port unit 24 can be made of thermoplastic material as in the container 22, thereby the discharge port unit 24 can be fused to the container 22 with heat. Accordingly, the container 22 and the discharge port unit 24 can be integrated as one part.

As shown in FIG. 5, the container 22 further includes a lock device 25 on the other end portion of the bottom face of the container 22. The lock device 25 includes a locking pawl 26 to lock the container 22 to the support plate 23.

Similar to the discharge port unit 24, the lock device 25 can be made of thermoplastic material, whereby the lock device 25 can be fused to the container 22 with heat. Accordingly, the container 22 and the lock device 25 can be integrated as one part.

Figure 6A:
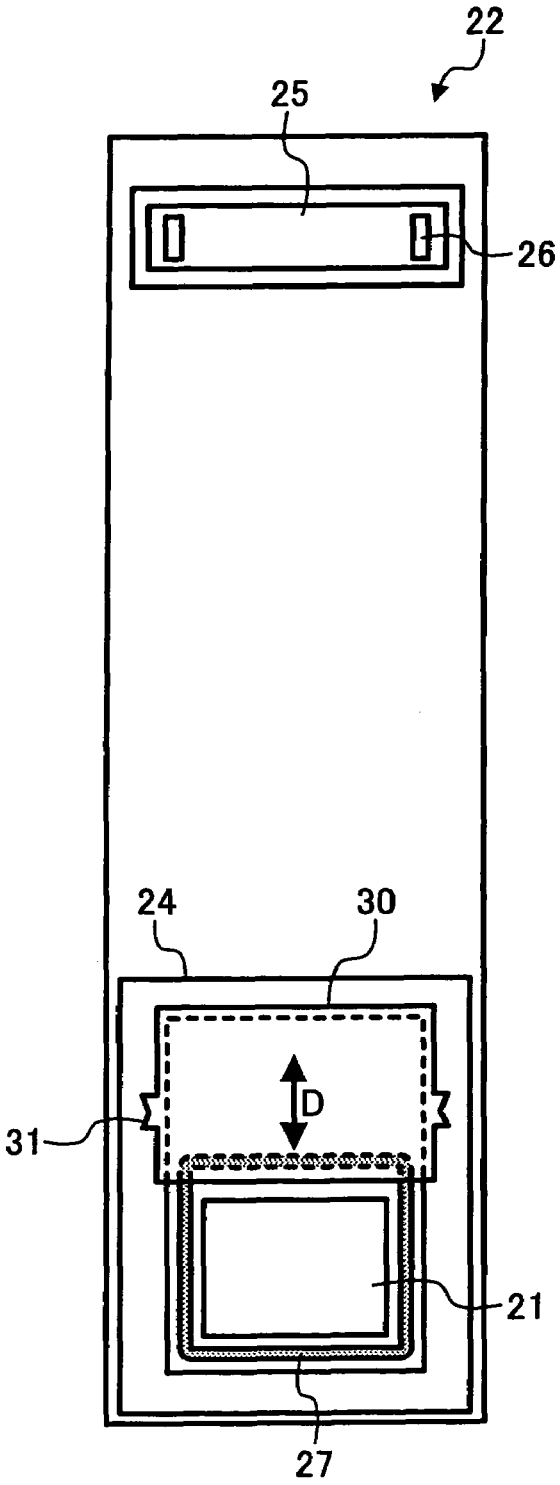
FIG. 6A is a schematic bottom view of a toner container of a toner cartridge in FIG. 5.
Figure 6B:
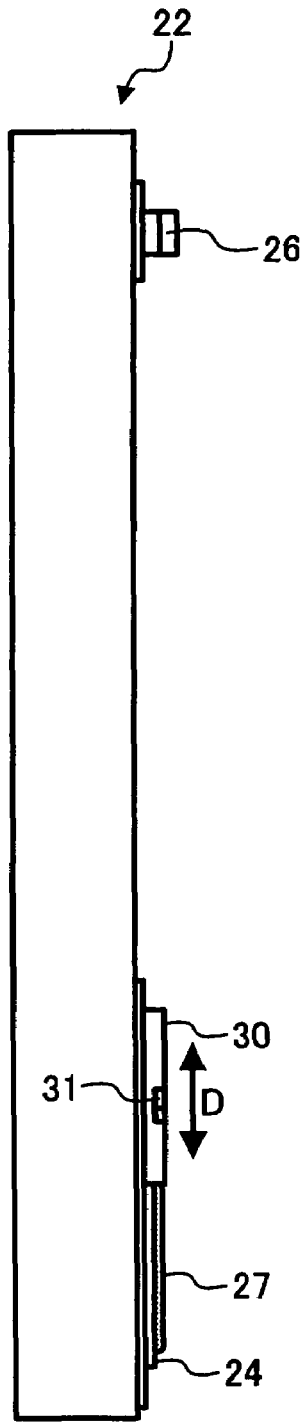
FIG. 6B is a schematic side view of a toner container of a toner cartridge in FIG. 5.

As shown in FIGS. 6A and 6B, the discharge port unit 24 includes the toner discharge port 21, a sealing ring 27, and a shutter 30.

The toner discharge port 21 is formed in a thin plate made of thermoplastic resinous material as shown in FIG. 6A.

As shown in FIG. 6A, the sealing ring 27, which fits in a groove formed around the toner discharge port 21, encircles the toner discharge port 21.

Furthermore, a guide rail (not shown) is formed on both lateral sides of the discharge port unit 24 so that the shutter 30 can slidably move on the discharge port unit 24 in a direction shown by an arrow D in FIGS. 6A and 6B, by which the toner discharge port 21 is opened and closed by the shutter 30.

When the shutter 30 moves on the sealing ring 27, the shutter 30 receives a friction force from the sealing ring 27, whereby force is required to move the shutter 30 on the sealing ring 27.

Furthermore, the shutter 30 includes a concaved engagement portion 31 on both lateral sides of the shutter 30 as shown in FIG. 6A, wherein the concaved engagement portion 31 engages an engagement pin 55 to be described later.

As above mentioned, the container 22, the discharge port unit 24, and the locking device 25 can be made as one integrated part by conducting heat fusing for the container 22, the discharge port unit 24, and the locking device 25. With such heat fusing, the container 22 having the discharge port unit 24 and the locking device 25 can be made economically.

When the toners in the container 22 is completely discharged and the container 22 becomes a toner end (i.e., toper empty) condition, the toner cartridge 20 is withdrawn from the image forming apparatus 100 and then the container 22 is detached from the support plate 23 to recover the container 22.

The recovered container 22 having the discharge port unit 24 and the locking device 25 can be used as a fuel for generating heat energy. For example, the recovered container 22 may be converted into a refuse derive fuel (RDF). The recovered container 22 includes different types of materials, thereby a material recycling may not be conducted effectively for the container 22.

The recovered container 22 may be cleaned and reused again as a container, however, such reuse process may require a relatively larger effort and time, thereby the recovered container 22 is not preferably reused from a viewpoint of handling cost for reuse.

As shown in FIG. 5, the support plate 23 includes an engaging section 32, a lock receiver 33, and a grip unit 34.

The engaging section 32 has a concave shape, which can engage the discharge port unit 24 of the container 22, and includes an open port 32*a* to be aligned to the toner discharge port 21 of the discharge port unit 24.

The lock receiver 33 engages the locking pawl 26 of the locking device 25 of the container 22.

A user can conduct an installing and withdrawing operation of the toner cartridge 20 with respect to the compartment in the image forming apparatus 100 by holding the grip unit 34.

Figure 7:
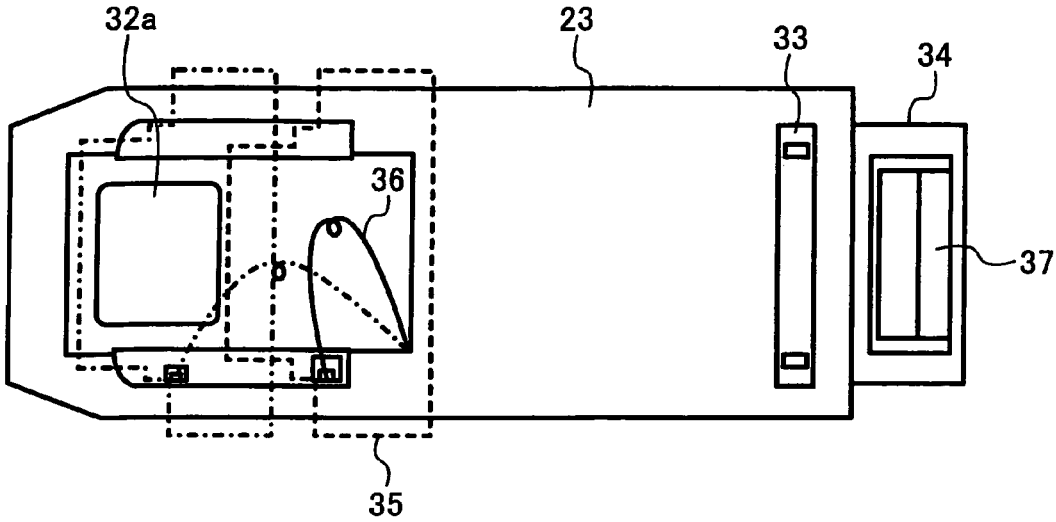
FIG. 7 is a schematic top view of a support plate of a toner cartridge in FIG. 5.
Figure 8:
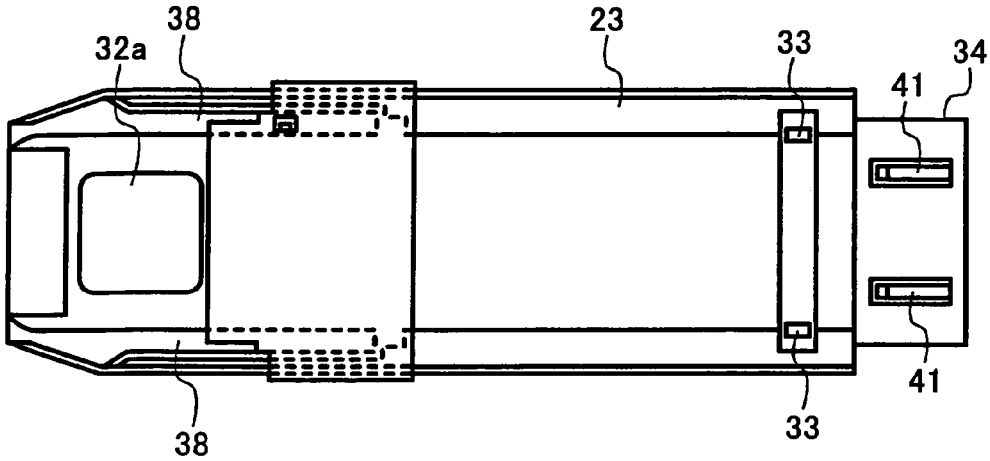
FIG. 8 is a schematic bottom view of a support plate of a toner cartridge in FIG. 5.

The open port 32*a* of the engaging section 32 can be shielded by a blind shutter 35, provided on the support plate 23 as shown in FIG. 7.

The blind shutter 35 can be made of a thin metal plate, for example.

The blind shutter 35 is slidably attached on the support plate 23, wherein the blind shutter 35 is slidable in a same direction of the shutter 30.

With the effect of a spring 36, which constantly biases the blind shutter 35, the blind shutter 35 can be held at a close position, which shields the open port 32*a* of the engaging section 32.

The grip unit 34 includes an action member 37. When the grip unit 34 is pushed down, the action member 37 can be pushed down simultaneously. With such push down movement, a locking pawl 41 (to be described later) is released from the oscillating unit 50.

As shown in FIG. 5, the length from the engaging section 32 to the lock receiver 33 on the support plate 23 is set as a length L1, and the length from the discharge port unit 24 to the locking pawl 26 on the container 22 is set as length L2.

In an example embodiment, the length L1 and length L2 have a following relationship that L1 is substantially equal to L2, or L2 is slightly longer than L1.

With such configuration, after engaging the discharge port unit 24 to the engaging section 32, the container 22 can be pulled in a direction toward the lock receiver 33 to lock the locking pawl 26 to the lock receiver 33, whereby a bottom face of the container 22 can be extended with a tensioned state, by which the bottom face of the container 22 can be free from wrinkles.

Accordingly, the container 22 made of softer material and formed in a rectangular parallelepiped shape can be free from wrinkles on a bottom face of the container 22.

If the wrinkles exist on the bottom face of the container 22, such wrinkles may inhibit discharge of toners from the toner discharge port 21 by accumulating toners at such wrinkles.

As for the toner cartridge 20 in an example embodiment, the container 22 includes the discharge port unit 24 having the shutter 30, thereby the container 22 can be marketed as one product. In this case, a user conducts an attachment/detachment work of the container 22 with respect to the support plate 23.

The user can easily fix the container 22 to the support plate 23 by engaging the discharge port unit 24 to the engaging section 32, and engaging the locking pawl 26 to the lock receiver 33 with the above-described method.

Figure 9:
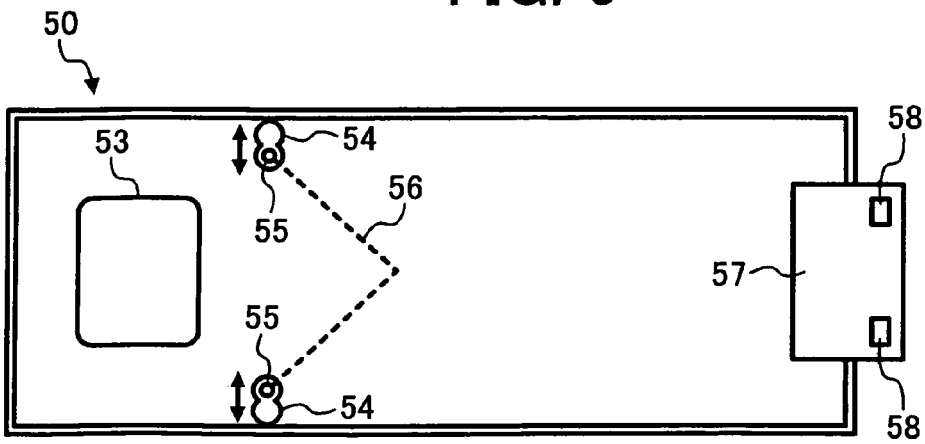
FIG. 9 is a schematic top view of an oscillating unit.

As shown in FIG. 9, the oscillating unit 50 includes the open port 53, two holes 54, two engagement pins 55, and a spring 56.

Each of the two engagement pins 55 is fixed on each end of the spring 56 as shown in FIG. 9, and is provided closer to the open port 53 of the oscillating unit 50.

Each of the two holes 54 has a shape which is consisted of two connected and overlapping holes as shown in FIG. 9. In other words, each of the two holes 54 has a shape which resembles a number "8" as a whole.

The engagement pins 55 can be inserted in the holes 54 as shown in FIG. 9.

Each of the engagement pins 55 is movable in the hole 54 as shown by an arrow in FIG. 9 while receiving a biasing force from the spring 56. The biasing force of the spring 56 biases the engagement pin 55 to a direction which brings the engagement pins 55 closer each other.

With providing the engagement pins 55 and the holes 54 in such configuration, an automatic opening or closing of the shutter 30 can be conducted when the toner cartridge 20 is inserted into the oscillating unit 50.

Hereinafter, such automatic opening or closing of the shutter 30 is explained in detail.

When the toner cartridge 20 is inserted into the oscillating unit 50, each of the engagement pins 55 engage the concaved engagement portion 31 of the shutter 30, and such engagement can induce an automatic opening of the shutter 30.

On one hand, when the toner cartridge 20 is withdrawn from the oscillating unit 50, each of the engagement pins 55 disengages the concaved engagement portion 31 of the shutter 30, and such disengagement can induce an automatic closing the shutter 30.

In an example embodiment, a guide groove 38 is formed on the support plate 23 to guide the engagement pins 55 to the concaved engagement portion 31 and to prevent disengagement of the engagement pins 55 from the concaved engagement portion 31.

As shown in FIG*s*. 10A and 10B, when the toner cartridge 20 is installed in the image forming apparatus 100, the toner cartridge 20 is inserted in the oscillating unit 50 from the insertion port 19.

As shown in FIG*s*. 10A and 10B, the oscillating unit 50 includes a guide wall 60 on both lateral side of the oscillating unit 50 to smoothly guide the toner cartridge 20 in the oscillating unit 50.

Figure 10B:
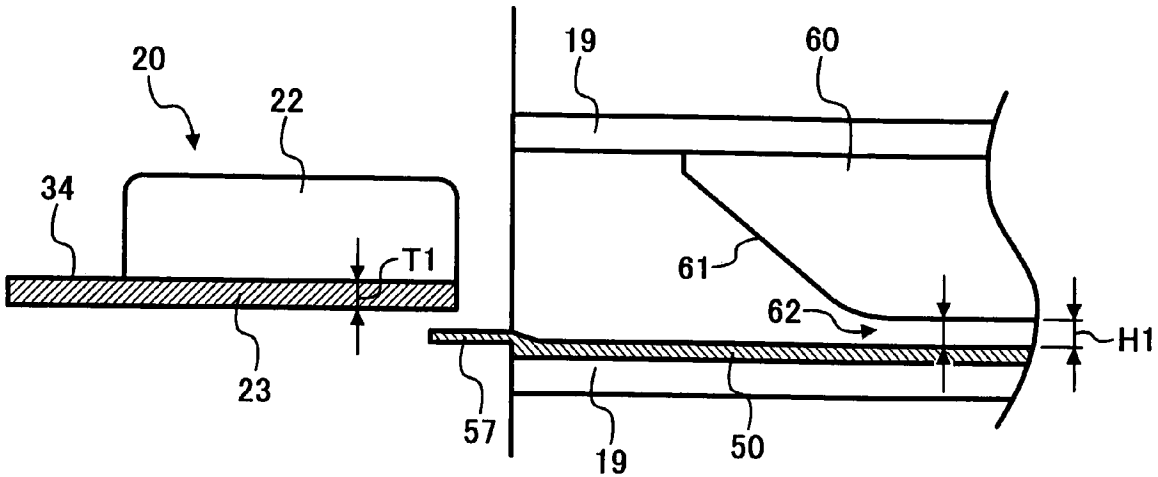
FIG. 10B is a schematic side view illustrating the relationship of a support plate of a toner cartridge and an oscillating unit.
Figure 10A:
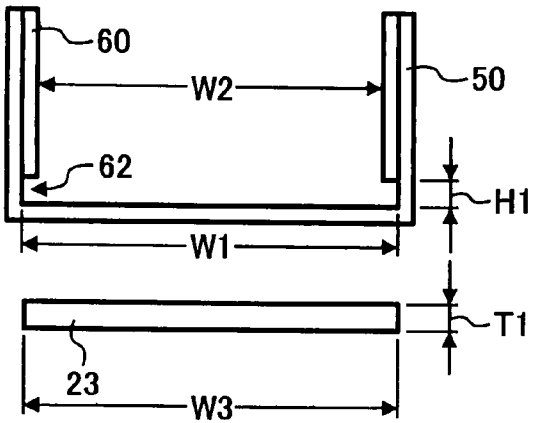
FIG. 10A is a schematic front view illustrating the relationship of a support plate of a toner cartridge and an oscillating unit.

The guide wall 60 is formed on a sidewall of the oscillating unit 50, and has a reclined portion 61 and a concaved portion 62 as shown in FIGS. 10A and 10B.

As shown in FIG. 10A, an inner width of the oscillating unit 50 is set to width W1, an interval width of the guide wall 60 is set to width W2, and a width of the support plate 23 of the toner cartridge 20 is set to width W3.

In an example embodiment, the widths W1, W2, and W3 have the relationship "W1>W3>W2."

As shown in FIGS. 10A and 10B, the height of the concaved portion 62 in the oscillating unit 50 is set to H1 and a thickness of the support plate 23 is set to T1.

In an example embodiment, H1 and T1 have the relationship "H1>T1."

Hereinafter, an installing operation of the toner cartridge 20 into the image forming apparatus 100 is explained in detail.

A user can install the toner cartridge 20 into the image forming apparatus 100 by inserting the toner cartridge 20 into the oscillating unit 50 from the insertion port 19.

As shown in FIG. 5, the support plate 23 has a front end and a rear end. As shown in FIGS. 11A to 11E, the front end of the support plate 23 has a corner-cut shape, thereby a width of the front end of the support plate 23 is smaller than a width of the rear end of the support plate 23.

With such corner-cut shape on the front end of the support plate 23, the support plate 23 can be inserted into the oscillating unit 50 easily.

Furthermore, the support plate 23 of the toner cartridge 20 is made of hard material having rigidity such as a thermosetting material, whereby both sides of the support plate 23 can be smoothly inserted into the oscillating unit 50 along the guide wall 60.

Because the support plate 23 and guide wall 60 have the relationships "W1>W3>W2" and "H1>T1" as above described, the support plate 23 can be guided along the reclined portion 61 and concaved portion 62 of the guide wall 60, and moved to a predetermined position in the oscillating unit 50.

Just before the toner cartridge 20 is set to a predetermined position in the oscillating unit 50, the toner discharge port 21 is automatically opened, wherein automatic opening of the toner discharge port 21 can be synchronized with a movement of the toner cartridge 20 in the oscillating unit 50.

FIGS. 11A to 11E explain such automatic opening process. In FIGS. 11A to 11E, the toner cartridge 20 is viewed from the bottom side of the oscillating unit 50.

Figure 11C:
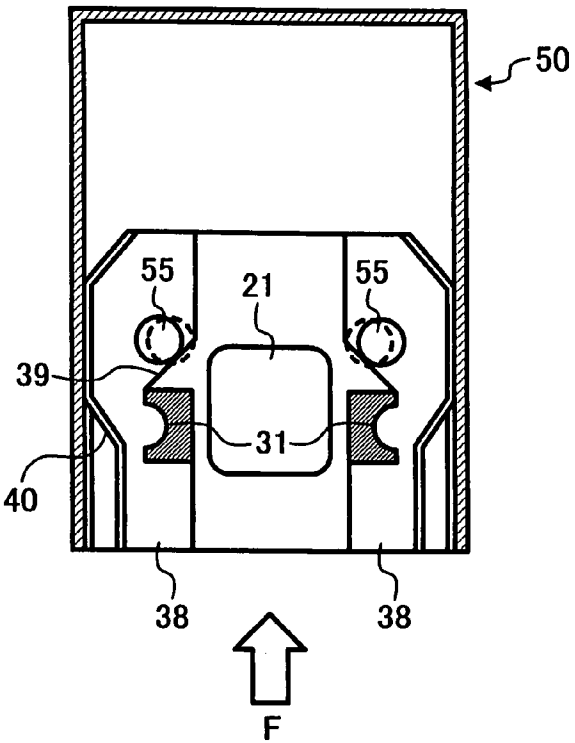
FIGS. 11A to 11E are schematic views illustrating the opening movement of a shutter when a toner cartridge is installed in an oscillating unit.
Figure 11B:
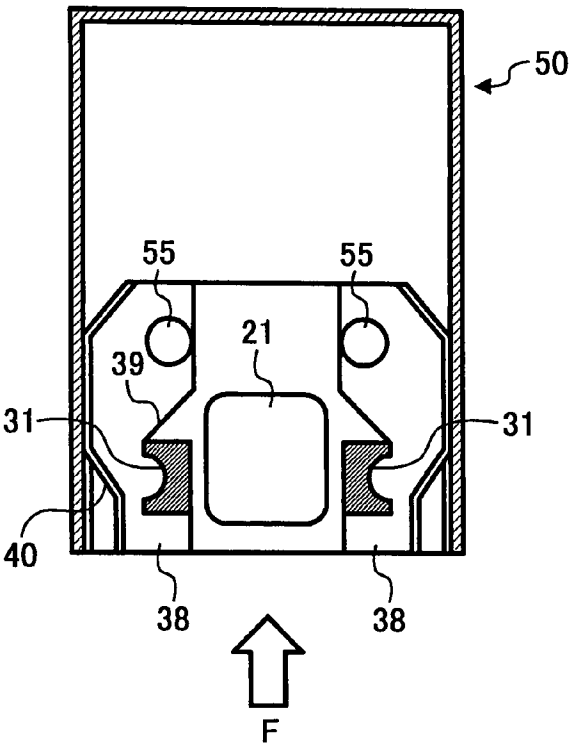
Figure 11A:
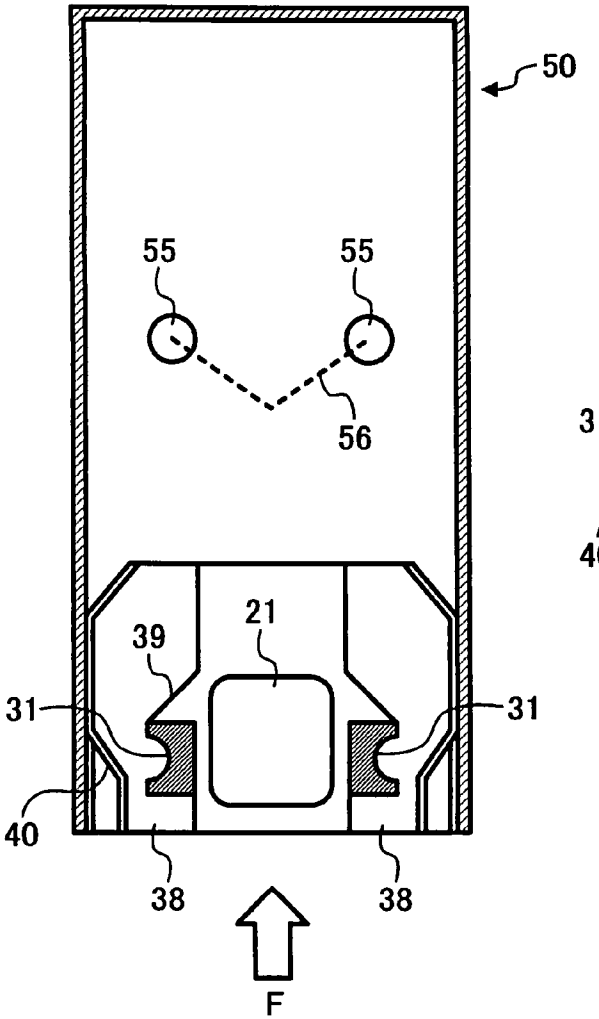

As shown in FIG. 11A, the toner cartridge 20 is inserted into the oscillating unit 50 in a direction shown by an arrow F.

Then, the engagement pins 55 of the oscillating unit 50 go into the guide groove 38 of the support plate 23 with an inserting movement of the toner cartridge 20 as shown in FIG. 11B.

During the inserting movement of the toner cartridge 20, the engagement pins 55 can contact an inner face of the guide groove 38 with the effect of biasing force of the spring 56.

During the inserting movement of the toner cartridge 20, the toner cartridge 20 continuously moves in the direction shown by an arrow F.

As shown in FIGS. 11A to 11E, the guide groove 38 has an inclined face 39, which shifts the position of the engagement pin 55 in the hole 54 toward an outward direction.

For simplifying the description of the drawing, the hole 54 is omitted in FIGS. 11A to 11E.

When the inclined face 39 contacts the engagement pins 55, the engagement pins 55 shift the position in the holes 54 to an outward direction as shown in FIG. 11C.

As shown in FIGS. 11A to 11E, an engagement assisting projection 40 is formed on the guide groove 38 around an end point of the inclined face 39.

Figure 11E:
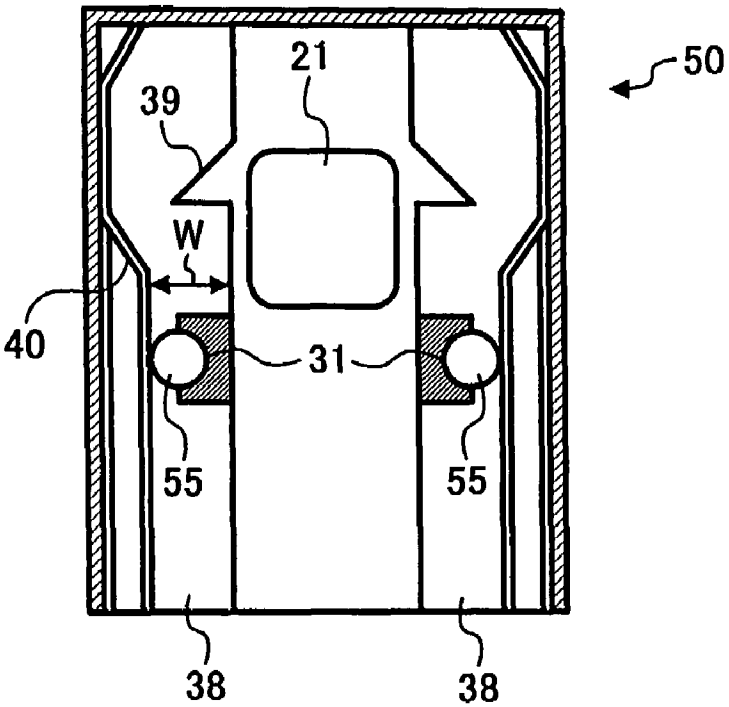
Figure 11D:
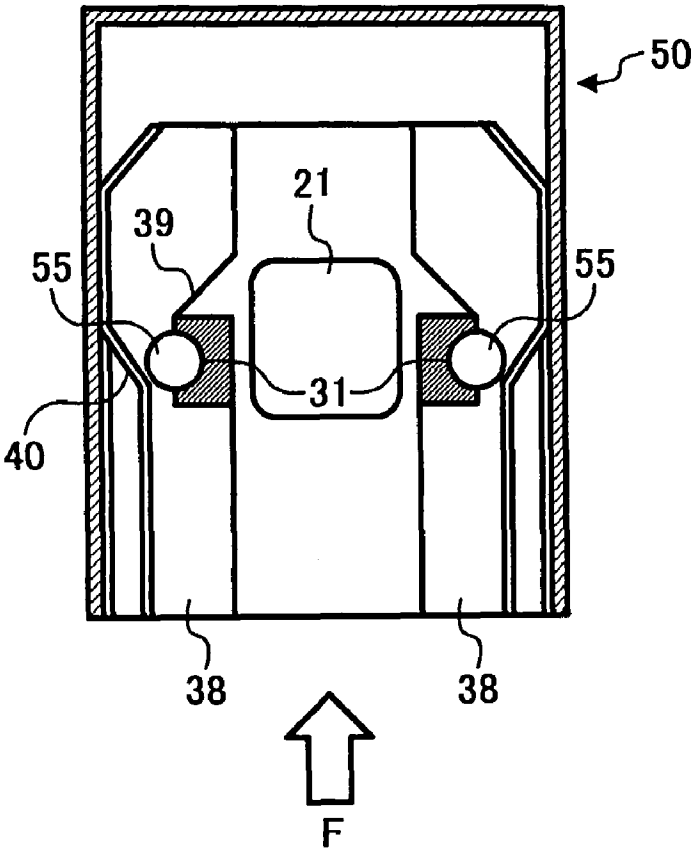

When the engagement pins 55 pass over the inclined face 39, each of the engagement pins 55 engages the concaved engagement portion 31 of the shutter 30 with the effect of the spring 56, which biases the engagement pins 55 in the holes 54 toward an inward direction, and the effect of the engagement assisting projection 40 as shown in FIG. 11D.

For simplifying the description of the drawing, the shutter 30 is omitted in FIG*s*. 11A to 11E.

With such engagement of the engagement pins 55 and the concaved engagement portion 31, movement of the shutter 30 in a direction shown by an arrow F stops although the toner cartridge 20 still moves in a direction shown by an arrow F as shown in FIG. 11D.

Then, the shutter 30 can start to open the toner discharge port 21 because the toner discharge port 21 still continues to move in a direction shown by an arrow F with the insertion movement of the toner cartridge 20.

As shown in FIG. 11E, the guide groove 38 has a width W, which can preferably prevent disengagement of the engagement pins 55 from the concaved engagement portion 31.

If a user can touch and move the concaved engagement portion 31 by use of a finger of the user, the shutter 30 may be moved and opened, which results in opening of the toner discharge port 21. Such situation is not preferable in view of toner related contamination such as toner leak.

Thereby the width W of guide groove 38 is preferably set to 10 mm or less, and more preferably from 4 mm to 6 mm, which can prevent insertion of a finger of the user into the guide groove 38.

Although not shown FIGS. 11A to 11E, the blind shutter 35, which is biased by the spring 36, can be opened synchronizingly with the shutter 30 because the engagement pins 55 can also push the blind shutter 35 when the toner cartridge 20 is inserted into the oscillating unit 50 in a direction shown by an arrow F.

In one example configuration, the engagement pins 55 can push the blind shutter 35 and the concaved engagement portion 31 of the shutter 30 simultaneously. In another example configuration, the engagement pins 55 can push the blind shutter 35 slightly earlier than pushing the concaved engagement portion 31 of the shutter 30.

With such synchronized opening movement of the blind shutter 35 and the shutter 30 when the toner cartridge 20 is inserted into the oscillating unit 50, the toner discharge port 21 can be opened when the toner discharge port 21 comes to a position right above the open ports 32*a* and 53.

Furthermore, the blind shutter 35 can shield the shutter 30 and guide groove 38, by which a user may not touch the concaved engagement portion 31 of the shutter 30.

In addition to the above-mentioned settings for the width W of the guide groove 38, the blind shutter 35 can further prevent a user from an unintentional touching to the concaved engagement portion 31 by a finger.

Figure 12A:
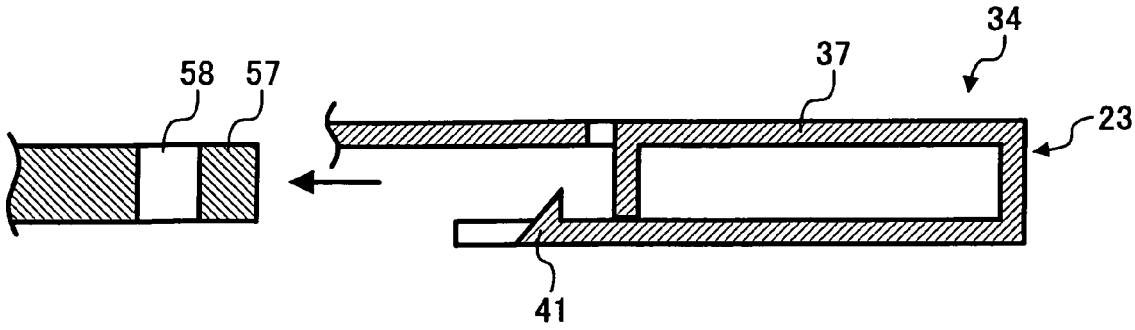
FIGS. 12A and 12B are schematic side views illustrating locking of a toner cartridge to an oscillating unit.
Figure 12B:
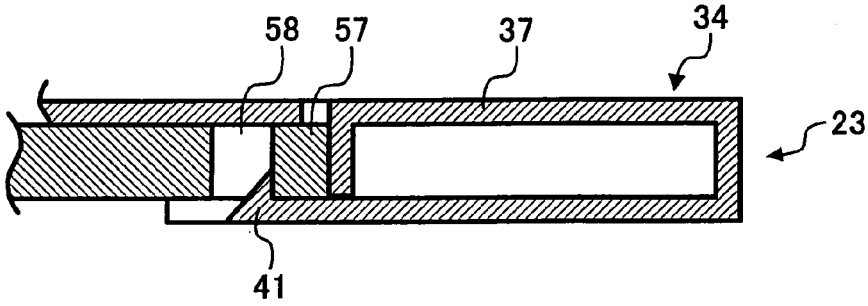

When the toner cartridge 20 is set in the oscillating unit 50, an lock plate 57 of the oscillating unit 50 can engage the locking pawl 41 of the grip unit 34 as shown in FIGS. 12A and 12B.

In such locking, the locking pawl 41 made of resinous material can engage in the engaging hole 58 of the lock plate 57 with an elastic effect of the locking pawl 41 made of resinous material.

With such locking, the toner cartridge 20 can be locked to the oscillating unit 50, thereby the toner cartridge 20 may not be disengaged from the oscillating unit 50 even if the oscillating unit 50 oscillates.

When the toner cartridge 20 is inserted into the oscillating unit 50 in a direction shown by an arrow F in FIGS. 11B to 11D, the engagement pins 55 can rotate on the surface of the guide groove 38. Thereby the toner cartridge 20 can be inserted into the oscillating unit 50 without receiving significant resistance from the engagement pins 55.

When the toner cartridge 20 becomes empty, a user can hold the grip unit 34 of the toner cartridge 20 to withdraw the toner cartridge 20 from the image forming apparatus 100.

Figure 12C:
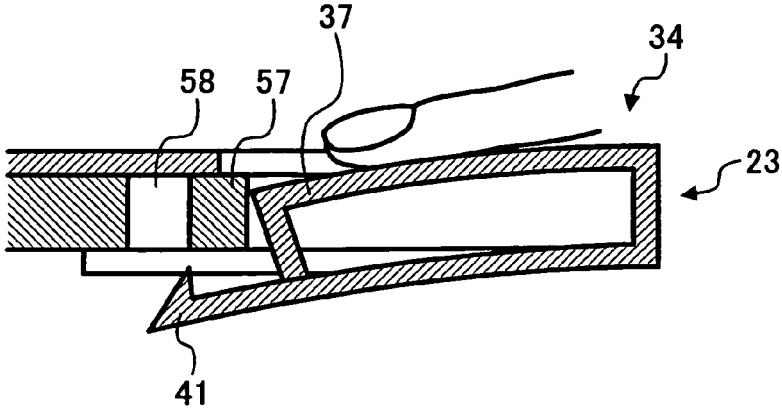
FIG. 12C is a schematic side view illustrating unlocking of a toner cartridge from an oscillating unit.

When the user holds the grip unit 34, the user can push the action member 37 almost automatically, thereby the locking pawl 41 can be disengaged from the engaging hole 58 as shown in FIG. 12C.

Accordingly, the user can withdraw the toner cartridge 20 from the image forming apparatus 100.

When the toner cartridge 20 is started to withdraw from the image forming apparatus 100, the shutter 30 and the blind shutter 35 synchronizingly start to close, which is similar to the opening of the shutter 30 and blind shutter 35 when installing the toner cartridge 20 into the image forming apparatus 100.

In case of withdrawing the toner cartridge 20 from the image forming apparatus 100, the toner cartridge 20 is withdrawn form the oscillating unit 50 in a direction opposite the direction shown by an arrow F in FIGS. 11B to 11D, whereby a withdrawal sequence of the toner cartridge 20 starts from FIG. 11E and ends in FIG. 11A.

The shutter 30 can close the toner discharge port 21 when the engagement pins 55, engaged to the concaved engagement portion 31, comes to a position facing the engagement assisting projection 40 (see FIG. 11D).

After the shutter 30 closes the toner discharge port 21, the engagement pins 55 can be disengaged from the concaved engagement portion 31 of the shutter 30 (see FIG. 11C).

Accordingly, the toner discharge port 21 can be closed when the toner cartridge 20 is withdrawn from the image forming apparatus 100.

Furthermore, the blind shutter 35 can be also closed when the toner cartridge 20 is withdrawn from the image forming apparatus 100.

Therefore, toner related contamination such as toner scattering and toner leak can be prevented when conducting a replacement work of the toner cartridge 20.

Although toner related contamination for the toner cartridge 20 can be prevented by closing the shutter 30, the blind shutter 35 is preferably provided to the support plate 23 of the toner cartridge 20 to further prevent toner related contamination for the toner cartridge 20.

In addition, the blind shutter 35 can prevent a user from unintentionally touching the concaved engagement portion 31 of the shutter 30 as above explained.

As above explained with an example embodiment, the shutter 30 can be automatically opened when the toner cartridge 20 is installed into the image forming apparatus 100, thereby a user do not have to peel of a sealing member from a toner discharge port, which is used in some conventional image forming apparatuses. Accordingly, the user can easily install the toner cartridge 20 into the image forming apparatus 100.

Furthermore, as can be understand from FIGS. 2, 10B, and 12A to 12C, the grip unit 34 is not inserted in the oscillating unit 50. In other words, the grip unit 34 is projected (or overhanged) from the insertion port 19. Therefore, a user can hold the grip unit 34 easily when to conduct an installing and withdrawing operation of the cartridge 20 with respect to the image forming apparatus 100.

In an example embodiment, an agent refill unit is explained as a toner refilling unit.

However, an agent refill unit according to an example embodiment can also be used for refilling carriers and developing agent having toners and carriers, for example.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2005-073183 filed on Mar. 15, 2005, No. 2005-073182 filed on Mar. 15, 2005, and No. 2005-073185 filed on Mar. 15, 2005 in the Japan Patent Office, the entire contents of which are hereby incorporated by reference herein.

The invention claimed is:

1. An agent containing unit for use in an image forming apparatus, comprising:

a container configured to store an agent and having an opening on a first end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned with the first discharge port, wherein the container having the discharge port unit further comprises a lock member provided at a second end portion of the container, and said support plate comprises a concave portion, provided at a first end portion of the support plate and having the second discharge port therein, and a lock receiver, provided at a second end portion of the support plate, and wherein the container is fixed on the support plate by engaging the discharge port unit with the concave portion of the support plate and by engaging the lock member with the lock receiver of the support plate.

2. The agent containing unit according to claim 1, wherein the discharge port unit comprises:

a connector having the first discharge port therein, fused to the opening of the container;

a sealing ring configured to encircle the first discharge port on the connector; and a first shutter configured to slidably move on the connector to open and close the first discharge port.

3. The agent containing unit according to claim 1, wherein the agent containing unit is configured to be firstly fixed to the support plate by engaging the discharge port unit to the concave portion of the support plate and is configured to be secondly fixed to the support plate by engaging the lock member to the lock receiver of the support plate, and wherein the container is pulled toward the end portion having the lock member when engaging the lock member to the lock receiver of the support plate to maintain the container at a tensioned state.

4. The agent containing unit according to claim 1, wherein the agent includes any one of a toner, a carrier, and a developing agent having toner and carrier.

5. The agent containing unit according to claim 1, wherein the container and the support plate include a substantially rectangular parallelepiped form.

6. The agent containing unit according to claim 1, wherein the container is made of a soft material, and the support plate is made of a rigid material.

7. The agent containing unit according to claim 6, wherein the container is made of a thermoplastic material, and the support plate is made of a thermosetting material.

8. The agent containing unit according to claim 6, wherein the container includes a deformable container configured to reduce a volume of the container when the container is in an empty condition.

9. The agent containing unit according to claim 6, wherein the container includes a transparent container.

10. The agent containing unit according to claim 6, wherein the container includes a paper-composite container made of paper layer and resinous layer laminated on the paper layer.

11. An agent refilling unit for use in an image forming apparatus, comprising:

an agent containing unit, the agent containing unit including a container configured to store an agent and having an opening on a first end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned to the first discharge port;

an oscillating unit configured to accept and support the agent containing unit and having a third discharge port aligned with the first and second discharge port, the oscillating unit including a pair of inner sidewalls that extend in a longitudinal direction of the oscillating unit; and a shutter opening/closing mechanism configured to open and close the first discharge port, wherein the oscillating unit further comprises a pair of guide walls, wherein each respective guide wall of the pair of guide walls is located on a respective inner sidewall of the pair of inner sidewalls so as to extend along a substantial portion of the respective inner sidewall in the longitudinal direction of the oscillating unit, and wherein the pair of guide walls are configured to guide the support plate of the agent containing unit into the oscillating unit, and wherein a distance between the pair of inner sidewalls in a transverse direction of the oscillating unit is greater than a distance between the pair of guide walls in the transverse direction of the oscillating unit.

12. The agent refill unit according to claim 11, wherein the discharge port unit of the agent containing unit comprises:

a connector having the first discharge port therein, fused to the opening of the container;

a sealing ring configured to encircle the first discharge port on the connector; and a first shutter configured to slidably move on the connector to open and close the first discharge port by the shutter opening/closing mechanism.

13. The agent refill unit according to claim 12, wherein the shutter opening/closing mechanism is configured to open the first shutter by synchronizing an opening movement of the first shutter with an insertion movement of the agent containing unit into the oscillating unit, and the shutter opening/closing mechanism is configured to close the first shutter by synchronizing a closing movement of the first shutter with a withdrawal movement of the agent containing unit from the oscillating unit.

14. The agent refill unit according to claim 11, wherein the oscillating unit is configured to oscillate in a longitudinal direction of the oscillating unit to facilitate discharging of the agent from the container.

15. The agent refill unit according to claim 11, wherein the pair of guide walls respectively include an inclined portion that is configured to guide the support plate to an inner bottom face of the oscillating unit.

16. An agent refilling unit for use in an image forming apparatus, comprising:

an agent containing unit, the agent containing unit including a container configured to store an agent and having an opening on a first end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned to the first discharge port;

an oscillating unit configured to accept and support the agent containing unit and having a third discharge port aligned with the first and second discharge port; and a shutter opening/closing mechanism configured to open and close the first discharge port, wherein the oscillating unit further comprises a guide wall, located on each inner sidewall of the oscillating unit, configured to guide the support plate of the agent containing unit into the oscillating unit, wherein the container having the discharge port unit further comprises a lock member provided at a second end portion of the container, and the support plate comprises a concave portion, provided at a first end portion of the support plate and having the second discharge port therein, and a lock receiver, provided at a second end portion of the support plate, and wherein the container is fixed on the support plate by engaging the discharge port unit to the concave portion of the support plate and by engaging the lock member to the lock receiver of the support plate.

17. The agent refill unit according to claim 16, wherein the support plate further comprises:

a lock pawl configured to engage with a lock hole of the oscillating unit to lock the agent containing unit to the oscillating unit when the agent containing unit is set in the oscillating unit; and a grip having a locking release mechanism configured to unlock the lock pawl from the lock hole, the grip being provided at the second end portion of the support plate, which is opposite to the first end portion of the support plate having the concave portion, and wherein the locking release mechanism unlocks the lock pawl from the lock hole to disengage the agent containing unit from the oscillating unit.

18. The agent refill unit according to claim 17, wherein the grip overhangs from the oscillating unit when the agent containing unit is set in the oscillating unit.

19. An agent refilling unit for use in an image forming apparatus, comprising:

an agent containing unit, the agent containing unit including a container configured to store an agent and having an opening on a first end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned to the first discharge port:

an oscillating unit configured to accept and support the agent containing unit and having a third discharge port aligned with the first and second discharge port; and a shutter opening/closing mechanism configured to open and close the first discharge port, wherein the oscillating unit further comprises a guide wall, located on each inner sidewall of the oscillating unit, configured to guide the support plate of the agent containing unit into the oscillating unit, and wherein the discharge port unit of the agent containing unit further includes a connector having the first discharge port therein, fused to the opening of the container;

a sealing ring configured to encircle the first discharge port on the connector; and a first shutter configured to slidably move on the connector to open and close the first discharge port by the shutter opening/closing mechanism, and wherein the shutter opening/closing mechanism includes a concave receiver located on each lateral side of the first shutter; and an engaging member, provided with the oscillating unit, configured to engage the concave receiver of the first shutter when the agent containing unit is inserted into the oscillating unit.

20. The agent refill unit according to claim 19, wherein the support plate further comprises a second shutter configured to shield the second discharge port, and wherein the second shutter is configured to be opened and closed by the shutter opening/closing mechanism.

21. The agent refill unit according to claim 20, wherein the second shutter is configured to shield the concaved receiver of the first shutter.

22. The agent refill unit according to claim 20, wherein the shutter opening/closing mechanism is configured to open and close the first and second shutter in a synchronized manner.

23. An agent refilling unit for use in an image forming apparatus, comprising:

an agent containing unit, the agent containing unit including a container configured to store an agent and having an opening on a first end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned to the first discharge port;

an oscillating unit configured to accept and support the agent containing unit and having a third discharge port aligned with the first and second discharge port, the oscillating unit including a pair of inner sidewalls that extend in a longitudinal direction of the oscillating unit; and a shutter opening/closing mechanism configured to open and close the first discharge port, wherein the support plate has a front end and a rear end, the front end has a width which is smaller than a width of the rear end of the support plate, and wherein the support plate is inserted into the oscillating unit from the front end of the support plate, and wherein the oscillating unit further comprises a pair of guide walls, wherein each respective guide wall of the pair of guide walls is located on a respective inner sidewall of the pair of inner sidewalls so as to extend along a substantial portion of the respective inner sidewall in a longitudinal direction of the oscillating unit, and wherein the pair of guide walls are configured to guide the support plate of the agent containing unit into the oscillating unit.

24. The agent refilling unit for use in an image forming apparatus according to claim 23, wherein a distance between the inner sidewalls in a transverse direction of the oscillating unit is greater than a distance between the guide walls in the transverse direction of the oscillating unit.

25. An image forming apparatus, comprising:

an agent containing unit, the agent containing unit including a container configured to store an agent and having an opening on one end portion of the container;

a discharge port unit, attached to the opening of the container, configured to cover the opening of the container and having a first discharge port, through which the agent is discharged from the container; and a support plate configured to support the container fixed detachably on the support plate, and having a second discharge port aligned to the first discharge port; and an agent refilling unit, comprising:

an oscillating unit configured to accept and support the agent containing unit and having a third discharge port aligned with the first and second discharge port, the oscillating unit including a pair of inner sidewalls that extend in a longitudinal direction of the oscillating unit; and a shutter opening/closing mechanism configured to open and close the first discharge port, wherein the oscillating unit further comprises a pair of guide walls, wherein each respective guide wall of the pair of guide walls is located on a respective inner sidewall of the pair of inner sidewalls so as to extend along a substantial portion of the respective inner sidewall in the longitudinal direction of the oscillating unit, and wherein the pair of guide walls are configured to guide the support plate of the agent containing unit into the oscillating unit, and wherein a distance between the pair of inner sidewalls in a transverse direction of the oscillating unit is greater than a distance between the pair of guide walls in the transverse direction of the oscillating unit.

26. The image forming apparatus according to claim 25, wherein the discharge port unit of the agent containing unit comprises:

a connector having the first discharge port therein, fused to the opening of the container;

a sealing ring configured to encircle the first discharge port on the connector; and a first shutter configured to slidably move on the connector to open and close the first discharge port by the shutter opening/closing mechanism.

27. An agent refilling unit for use in an image forming apparatus, comprising:

an agent containing unit, comprising:

means for storing an agent, having an opening;

means for covering the opening of the means for storing an agent, having a first discharge port, through which the agent is discharged from the means for storing; and means for supporting the means for storing an agent, detachably fixed on the means for supporting, and having a second discharge port aligned with the first discharge port;

means for accepting the agent containing unit, and having a third discharge port aligned with the first and second discharge port;

means for oscillating the means for accepting the agent containing unit to facilitate discharging of the agent from the means for storing the agent, the means for oscillating the means for accepting the agent containing unit including a pair of inner sidewalls that extend in a longitudinal direction of the means for oscillating the means for accepting the agent containing unit; and means for opening and closing the first discharge port, wherein the means for oscillating the means for accepting the agent containing unit further comprises a pair of guide walls, wherein each respective guide wall of the pair of guide walls is located on a respective inner sidewall of the pair of inner sidewalls so as to extend along a substantial portion of the respective inner sidewall in the longitudinal direction of the means for oscillating the means for accepting the agent containing unit, and wherein the pair of guide walls are configured to guide the means for supporting the means for storing an agent into the means for oscillating the means for accepting the agent containing unit, and wherein a distance between the pair of inner sidewalls in a transverse direction of the means for oscillating the means for accepting the agent containing unit is greater than a distance between the pair of guide walls in the transverse direction of the means for oscillating the means for accepting the agent containing unit.

* * * * *